US005874396A

United States Patent [19]

Littig et al.

[11] Patent Number: 5,874,396

[45] Date of Patent: Feb. 23, 1999

[54] RINSE ADDED LAUNDRY ADDITIVE COMPOSITIONS HAVING COLOR CARE AGENTS

[75] Inventors: Janet Sue Littig, Fairfield; Frederick A. Hartman, Cincinnati; Mark Robert Sivik, Fairfield, all of Ohio

[73] Assignee: The Procter & Gamble Company, Cincinnati, Ohio

[21] Appl. No.: 993,251

[22] Filed: Dec. 18, 1997

Related U.S. Application Data

[60] Provisional application No. 60/039,223 Feb. 28, 1997.

[51] Int. Cl.[6] ..... C11D 1/62; C11D 1/835; C11D 3/30

[52] U.S. Cl. ..... 510/504; 510/499; 510/522

[58] Field of Search ..... 510/504, 499, 510/520, 522, 524

[56] References Cited

U.S. PATENT DOCUMENTS

| | | | |
|---|---|---|---|
| 4,263,179 | 4/1981 | Schmolka | 252/548 |
| 4,390,439 | 6/1983 | Schwartz et al. | 252/73 |
| 4,536,254 | 8/1985 | Falk et al. | 162/135 |
| 4,764,289 | 8/1988 | Trinh | 252/8.6 |
| 5,114,717 | 5/1992 | Kuznitz et al. | 424/401 |
| 5,128,123 | 7/1992 | Brewster et al. | 424/65 |
| 5,186,156 | 2/1993 | Holland | 252/143 |
| 5,221,496 | 6/1993 | Holland | 252/143 |
| 5,258,174 | 11/1993 | Schebece | 424/65 |
| 5,332,714 | 7/1994 | Albrecht et al. | 504/116 |
| 5,405,605 | 4/1995 | Shin | 424/68 |
| 5,451,399 | 9/1995 | Gimbrone, Jr. et al. | 424/85.2 |

FOREIGN PATENT DOCUMENTS

| | | | |
|---|---|---|---|
| 06-299141 | 10/1994 | Japan | C09K 3/16 |

*Primary Examiner*—Paul Lieberman
*Assistant Examiner*—John R. Hardee
*Attorney, Agent, or Firm*—R. S. Echler, Sr.; K. W. Zerby; J. C. Rasser

[57] ABSTRACT

The present invention relates to rinse-added laundry additive compositions having a color care agent and to methods for using the compositions. The laundry additive composition comprises from about 0.1% to about 50% of by weight of the composition of a color care agent having the formula:

$$(R_1)(R_2)N(CX_2)_nN(R_3)(R_4)$$

wherein X is selected from the group consisting of hydrogen, linear or branched; substituted or unsubstituted alkyl having from 1–10 carbons atoms and substituted or unsubstituted aryl having at least 6 carbon atoms; n is an integer from 1 to 6; $R_1$, $R_2$, $R_3$, and $R_4$ are independently selected from the group consisting of alkyl; aryl; alkaryl; arylalk; hydroxyalkyl; polyhydroxyalkyl; polyalkylether having the formula $—((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: $—(O(CH_2)_y)_zR_7$; the group $—C(O)R_8$ where $R_8$ is alkyl; alkaryl; arylalk; hydroxyalkyl; polyhydroxyalkyl, and polyalkylether as defined in $R_1$, $R_2$, $R_3$, and $R_4$; $CX_2CX_2N(R_5)(R_6)$ with no more than one of $R_1$, $R_2$, $R_3$, and $R_4$ being $CX_2CX_2N(R_5)(R_6)$ and wherein $R_5$ and $R_6$ are alkyl; alkaryl; arylalk; hydroxyalkyl; polyhydroxyalkyl, polyalkylether, alkoxy and polyalkoxy as defined in $R_1$, $R_2$, $R_3$, and $R_4$; and either of $R_1$+$R_3$ or $R_4$ or $R_2$+$R_3$ or $R_4$ can combine to form a cyclic substituent. Optional ingredients include a quaternary ammonium fabric softening compound.

4 Claims, No Drawings

RINSE ADDED LAUNDRY ADDITIVE COMPOSITIONS HAVING COLOR CARE AGENTS

This is a provisional application Ser. No. 60/039,273 filed Feb. 28, 1997.

TECHNICAL FIELD

The present invention relates to rinse added, laundry additive compositions and methods for using the same during the rinse cycle of a consumer laundry process. More particularly, the present invention relates to liquid, rinse added laundry additive compositions having color care agents.

BACKGROUND OF THE INVENTION

Consumer use of rinse added laundry additive compositions has increased in popularity in recent years. The popularity of these compositions has risen in part due to consumer desire to impart various properties to fabrics easily and quickly during the laundry process. A wide variety of ingredients have been suggested for use in laundry additive compositions to enhance the appearance and feel of fabrics. Fabric softeners provide both softening and anti-static benefits to fabrics. Perfumes deliver pleasing odors and freshness. Rinse added laundry products offer convenience, ease of use, and affordable economics to consumers as well as being superior delivery systems for desirable laundry additives such as perfumes and softeners.

In the meantime, colored items remain a large percentage of home or consumer laundered garments. These colored garments have an undesirable tendency to show appearance and color losses after multiple cycles through a laundry process. These appearance and color losses may be manifested after many multiples of cycles or only a few cycles through the laundry process. Thus, the usable lifetime of colored garments is reduced by the laundering process.

Accordingly, there is a need for a laundry additive composition which through the regular use of the additive composition can reduce or eliminate appearance and color losses due to the laundering process and thereby substantially increase the usable lifetime of colored garments. Also desired is a laundry additive composition which will not only reduce or eliminate color and appearance losses through regular use but which will also provide a noticeable appearance improvement to previously laundered garments which have undergone a degradation in appearance and/or color. Particularly desirable is a rinse added composition with the aforementioned benefits.

SUMMARY OF THE INVENTION

The present invention relates to rinse added laundry additive compositions having a color care agent. Methods for using the compositions are also provided. Improved softness, perfume delivery and/or antistatic effects may also be provided.

In accordance with a first aspect of the present invention, a rinse-added laundry additive composition is provided. The composition comprises from about 0.1% to about 50% of by weight of the composition of a color care agent having the formula:

$$(R_1)(R_2)N(CX_2)_nN(R_3)(R_4)$$

wherein X is selected from the group consisting of hydrogen, linear or branched, substituted or unsubstituted alkyl having from 1–10 carbons atoms and substituted or unsubstituted aryl having at least 6 carbon atoms; n is an integer from 0 to 6; $R_1$, $R_2$, $R_3$, and $R_4$ are independently selected from the group consisting of alkyl; aryl; alkaryl; arylalk; hydroxyalkyl; polyhydroxyalkyl; polyalkylether having the formula $—((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: $—(O(CH_2)_y)_zR_7$; the group $—C(O)R_8$ where $R_8$ is alkyl; alkaryl; arylalk; hydroxyalkyl; polyhydroxyalkyl and polyalkyether as defined in $R_1$, $R_2$, $R_3$, and $R_4$; $CX_2CX_2N(R_5)(R_6)$ with no more than one of $R_1$, $R_2$, $R_3$, and $R_4$ being $CX_2CX_2N(R_5)(R_6)$ and wherein $R_5$ and $R_6$ are alkyl; alkaryl; arylalk; hydroxyalkyl; polyhydroxyalkyl; polyalkylether; alkoxy and polyalkoxy as defined in $R_1$, $R_2$, $R_3$, and $R_4$; and either of $R_1$+$R_3$ or $R_4$ or $R_2$+$R_3$ or $R_4$ can combine to form a cyclic substituent.

Preferred compositions include those where $R_1$, $R_2$, $R_3$, and $R_4$ are independently selected from the group consisting of alkyl groups having from 1 to 10 carbon atoms and hydroxyalkyl groups having from 1 to 5 carbon atoms, preferably ethyl, methyl, hydroxyethyl, hydroxypropyl and isohydroxypropyl. The color care agent has more than about 1% nitrogen by weight of the compound, and preferably more than 7%.

Optional ingredients include a quaternary ammonium fabric softening compound or amine precursor thereof, preferably one having the formula:

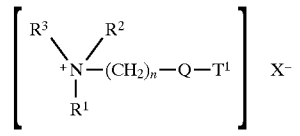

(I)

or

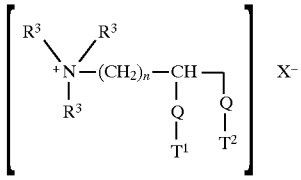

(II)

wherein Q is —O—C(O)— or —C(O)—O— or —O—C(O)—O— or $—NR^4—C(O)—$ or $—C(O)—NR^4—$; $R^1$ is $(CH_2)_n—Q—T^2$ or $T^3$ or $R^3$; $R^2$ is $(CH_2)_m—Q—T^4$ or $T^5$ or $R^3$; $R^3$ is $C_1$–$C_4$ alkyl or $C_1$–$C_4$ hydroxyalkyl or H; $R^4$ is H or $C_1$–$C_4$ alkyl or $C_1$–$C_4$ hydroxyalkyl; $T^1$, $T^2$, $T^3$, $T^4$, $T^5$ are (the same or different) $C_{11}$–$C_{22}$ alkyl or alkenyl; n and m are integers from 1 to 4; and $X^-$ is a softener-compatible anion, the alkyl, or alkenyl, chain $T^1$, $T^2$, $T^3$, $T^4$, $T^5$ must contain at least 11 carbon atoms, and most preferably N,N-di (tallowyl-oxy-ethyl)-N,N-dimethyl ammonium chloride.

According to another embodiment of the present invention, rinse added fabric softening composition is provided. This composition includes both the color care agent and the quaternary ammonium compounds substantially as described above. According to yet another embodiment of the present invention, a method for treating colored garments is provided. The method comprises contacting at least one colored garment and at least about 50 ppm of the laundry additive compositions hereinbefore described.

Accordingly, it is an object of the present invention to provide a laundry additive composition which through the regular use of the additive composition can reduce or eliminate appearance and color losses due to the laundering process and thereby substantially increase the usable lifetime of colored garments. It is also an object of the present invention to provide a laundry additive composition which will not only reduce or eliminate color and appearance losses through regular use but which will also provide a noticeable appearance improvement to previously laundered garments which have undergone a degradation in appearance and/or color. It is a feature of the present invention to provide a laundry additive composition having a color care agent or compound included in the composition or product. These and other objects, features and advantages of the present invention will be recognizable to one of ordinary skill in the art from the following description and the appended claims.

All percentages, ratios and proportions herein are on a weight basis unless otherwise indicated. All documents cited herein are hereby incorporated by reference.

DETAILED DESCRIPTION OF THE PREFERRED EMBODIMENTS

The present invention relates to rinse-added laundry additive compositions having a color care agent. The compositions deliver superior color and/or appearance benefits including the reduction and/or elimination of color losses due to the laundering process. In addition, the composition of the present invention can also, in certain circumstances, improve the appearance of colored garments which have previously undergone a degradation in appearance and/or color loss. Additional features including improved softness, and/or antistatic effects, may also be delivered via the present invention.

(1) Color Care Agent

The rinse-added laundry additive compositions of the present invention include a color care agent. The compositions may include from about 0.1% to about 50% by weight of the composition of the color care agent. More typically, the compositions comprise from about 0.1% to about 20%, preferably about 0.1% to about 10% and most preferably from about 0.5% to about 7% by weight of the composition of the color care agent.

The color care agent of the present invention is characterized by the formula:

$$(R_1)(R_2)N(CX_2)_nN(R_3)(R_4). \quad (I)$$

In formula (I), X is selected from the group consisting of hydrogen, linear or branched, substituted or unsubstituted alkyl having from 1 to 10 carbons atoms and substituted or unsubstituted aryl having from 6 to 22 carbon atoms and n is an integer from 0 to 6. In addition, the group —$(CX_2)$— may involve a cyclic group such as cyclic $C_6H_{10}$. Preferably X is hydrogen or a linear, unsubstituted alkyl chain having from 1 to 5 carbon atoms. However, branched chain alkyl groups such as isopropyl and isobutyl may also be employed. Most preferably, n is 2 or 3 and X is hydrogen, respectively resulting in the core structure $(R_1)(R_2)N(CH_2CH_2)N(R_3)(R_4)$.

As for the groups $R_1$, $R_2$, $R_3$, and $R_4$, each is individually or independently selected from the group consisting of hydrogen; alkyl; alkaryl; arylalkyl; hydroxyalkyl; polyhydroxyalkyl; polyalkylether having the formula —$((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: —$(O(CH_2)_y)_zR_7$; the group —$C(O)R_8$ where $R_8$ is alkyl; alkaryl; arylalk; hydroxyalkyl; polyalkylether, polyhydroxyalkyl, and $CX_2CX_2N(R_5)(R_6)$.

The available alkyl groups include linear or branched, substituted or unsubstituted alkyl groups typically having from about 1 to about 22 carbon atoms, preferably 1–10 carbon atoms. Most preferred alkyl groups include methyl, ethyl, propyl, and isopropyl. The available aryl groups include substituted or unsubstituted aryl groups typically having from about 6 to about 22 carbon atoms. Substitutions may include alkyl chains as earlier described thereby providing alkaryl or arylalk groups having from about 6 to about 22 carbon atoms. Preferred aryl, arylalk and alkaryl groups include phenyl, benzyl and mesityl. The preferred hydroxyalkyl and polyhydroxyalkyl groups include linear or branched, substituted or unsubstituted groups typically having from about 1 to about 22 carbon atoms. Preferred groups include hydroxymethyl, hydroxyethyl, 1-hydroxypropyl and 2-hydroxypropyl. The available polyalkoxy groups include those having the formula: —$(O(CH_2)_y)_zR_7$. The integer y typically ranges from 2 to about 10 with 1, 2, and 3 the most preferred. The group —$(CH_2)_y$— may include both linear and branched chains. Preferred groups include methoxyl, ethoxyl and isopropoxyl. The integer z typically ranges from about 1 to 30 with lower levels of ethoxylation being preferred. $R_7$ is typically hydrogen or an alkyl groups having 1 to 5 carbon atoms. Polyalkylether having the formula —$((CH_2)_yO)_zR_7$ may also be employed in the present invention with y typically ranging from 2 to about 10 with 1, 2, and 3 the most preferred, the group —$(CH_2)_y$— including both linear and branched chains with methoxyl, ethoxyl and isopropoxy preferred and the integer z ranging from about 1 to 30 with lower levels of ethoxylation being preferred. The group —$C(O)R_8$ may also be employed where $R_8$ is alkyl; alkaryl; arylalk; hydroxyalkyl; polyhydroxyalkyl; and polyalkylether as defined above.

$R_1$, $R_2$, $R_3$, and $R_4$ may also be the group $CX_2CX_2N(R_5)(R_6)$. However, when the group is present, no more than one of $R_1$, $R_2$, $R_3$, and $R_4$ at any one time may be the group $CX_2CX_2N(R_5)(R_6)$. Furthermore, $R_5$ and $R_6$ are alkyl; alkaryl; arylalkyl; hydroxyalkyl; polyhydroxyalkyl, polyalkylether, alkoxy and polyalkoxy as defined above for $R_1$, $R_2$, $R_3$, and $R_4$. Preferably, when any one of $R_1$, $R_2$, $R_3$, and $R_4$ is present as the group $CX_2CX_2N(R_5)(R_6)$, then $R_5$ and $R_6$ are preferably, alkyl or hydroxyalkyl groups as defined above. Lastly, either of $R_1$+$R_3$ or $R_4$ or $R_2$+$R_3$ or $R_4$ can combine to form a cyclic substituent. Suitable examples include the moiety:

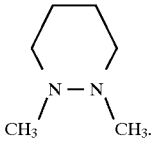

To provide suitable color care properties, the preferred color care agent materials according to the present invention consist of not less than 1% by weight of the compound of nitrogen, more preferably not less than 7% and most preferably not less than 9% by weight of the compound.

Most preferably, $R_1$, $R_2$, $R_3$, and $R_4$ are independently selected from the group consisting of linear alkyl groups having from 1 to 5 carbon atoms and linear hydroxyalkyl groups having from 1 to 5 carbon atoms. Especially preferred are the groups ethyl, methyl, hydroxyethyl and hydroxypropyl. While each of $R_1$, $R_2$, $R_3$, and $R_4$ may be individually selected, the preferred color care component according to the present invention involves the situation wherein each of $R_1$, $R_2$, $R_3$, and $R_4$ are hydroxyalkyl groups having from 1 to 5 carbon atoms. A preferred list of compounds includes N,N,N',N' tetraethylethylenediamine, 2-{[2-(dimethylamino)ethyl]-methylamino}ethanol, Bis-(2-hydroxyethyl)-N,N'-dimethylethylenediamine, Bis(octyl)-N,N'-dimethylethylenediamine, N,N,N',N",N" penta(2-hydroxypropyl)diethylenetriamine and N,N,N',N'-tetrakis (2-hydroxypropyl) ethylenediamine. Particularly preferred is N,N,N',N'-tetrakis(2-hydroxypropyl) ethylenediamine and N,N,N',N",N" penta(2-hydroxypropyl) diethylenetriamine. Such materials are commercially available from a number of sources including BASF of Washington, NJ under the tradename QUADROL and PENTROL.

(2) Quaternary Ammonium Compounds

The preferred quaternary ammonium compounds or amine precursors of the present invention are cationic biodegradable quaternary ammonium compounds having the formula (II) or (III), below:

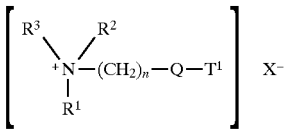

(II)

or

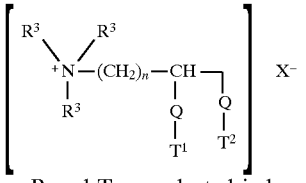

(III)

wherein Q, n, R and T are selected independently and

Q is —O—C(O)— or —C(O)—O— or —O—C(O)—O— or —$NR^4$—C(O)— or —C(O)—$NR^4$—;

$R^1$ is $(CH_2)_n$—Q—$T^2$ or $T^3$ or $R^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are (the same or different) $C_{11}$–$C_{22}$ alkyl or alkenyl;

n and m are integers from 1 to 4; and $X^-$ is a softener-compatible anion, such as chloride, methyl sulfate, etc.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Q, n, $T^1$, and $T^2$ may be the same or different when more than one is present in the molecule.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Preferred quaternary ammonium compounds or amine precursors thereof include those of formula (II) or (III) wherein Q is —O—C(O)—, $R^1$ is $(CH_2)_n$—Q—$T^2$, $R^2$ and $R^3$ are the same or different and are $C_1$–$C_4$ alkyl or $C_1$–$C_4$ hydroxyalkyl or H; $T^1$ and $T^2$ are (the same or different) $C_{11}$–$C_{22}$ alkyl or alkenyl; n and m are integers from 1 to 4; and $X^-$ is a softener-compatible anion, such as chloride, methyl sulfate, etc.

Specific examples of quaternary ammonium compounds of formula (II) or (III) suitable for use in the aqueous fabric softening compositions herein include:

1) N,N-di(tallowyl-oxy-ethyl)-N,N-dimethyl ammonium chloride;

2) N,N-di(tallowyl-oxy-ethyl)-N-methyl, N-(2-hydroxyethyl) ammonium chloride;

3) 1,2-ditallowyloxy-3-N,N,N-trimethylammoniopropane chloride.; and mixtures of any of the above materials.

Of these, compounds 1–2 are examples of compounds of Formula (II); compound 3 is a compound of Formula (III).

Particularly preferred is N,N-di(tallowoyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (II) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentrability.

For compounds of Formula (II) made from tallow fatty acids having a IV of above 25, the ratio of cis to trans isomers has been found to be less critical unless very high concentrations are needed.

At least 80% of the preferred diester quaternary ammonium compounds, i.e., DEQA of formula (II) and (III) is preferably in the diester form, and from 0% to about 20%, preferably less than about 15%, more preferably less than about 10%, can be monoester, i.e., DEQA monoester (e.g., containing only one —Q—$T^1$ group). As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

Other examples of suitable quaternary ammonium compounds of Formula (II) and (III) are obtained by, e.g., replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion. By "amine precursors thereof" is meant the secondary or tertiary amines corresponding to the above quaternary ammonium compounds.

Other formula (II) quaternary ammonium compounds useful as fabric softeners in the present invention include:

(i) diamido quaternary ammonium salts having the formula:

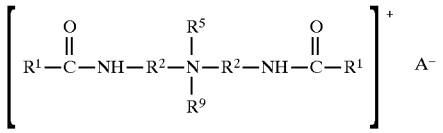

wherein $R^1$ is an acyclic aliphatic $C_{15}$–$C_{21}$ hydrocarbon group, each $R^2$ is the same or different divalent alkylene group having 1 to 3 carbon atoms, $R^5$ and $R^9$ are $C_1$–$C_4$ saturated alkyl or hydroxyalkyl groups, or $(CH_2CH_2O)_nH$ wherein n is equal to 1 to about 5 and $A^-$ is an anion;

(ii)

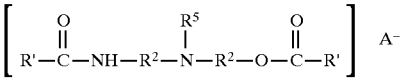

wherein $R^1$ is an acyclic aliphatic $C_{15}$–$C_{21}$ hydrocarbon group, $R^2$ is the same or different divalent alkylene group having 1 to 3 carbon atoms, $R^5$ are $C_1$–$C_4$ saturated alkyl or hydroxyalkyl groups, $A^-$ is an anion and $R^2$ is the same or different from the other $R^2$, and (iii) mixtures thereof.

Examples of compounds of (i) or (ii) as described above are the well-known and include methyl bis(tallowamidoethyl)(2-hydroxyethyl)ammonium methylsulfate and methyl bis(hydrogenated tallowamidoethyl)(2-hydroxyethyl)ammonium methylsulfate; these materials are available from Witco Chemical Company under the trade names Varisoft® 222 and Varisoft® 110, respectively: The quaternary ammonium or amine precursors compounds herein are present at levels of from about 0.05% to about 50% by weight of compositions herein, depending on the composition execution which can be dilute with a preferred level of active from about 5% to about 15% by weight, or concentrated, with a preferred level of active from about 15% to about 50%, most preferably about 15% to about 35% by weight.

For the preceding fabric softening agents, the pH of the compositions herein is an important parameter of the present invention. Indeed, it influences the stability of the quaternary ammonium or amine precursors compounds, especially in prolonged storage conditions. The pH, as defined in the present context, is measured in the neat compositions at 20° C. The pH of the present invention may range from about 2 to about 7. The pH of the composition will depend upon the stability of various ingredients including the quaternary ammonium fabric softening compound. The pH of these compositions herein can be regulated by the addition of a Bronsted acid.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Alternative Cationic Ammonium Compounds

Additional cationic fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. Nos.: 3,861,870, Edwards and Diehl; 4,308,151, Cambre; 3,886,075, Bernardino; 4,233,164, Davis; 4,401,578, Verbruggen; 3,974,076, Wiersema and Rieke; 4,237,016, Rudkin, Clint, and Young; and European Patent Application publication No. 472,178, by Yamamura et al., the disclosures of which are all herein incorporated by reference.

For example, additional cationic fabric softener agents useful herein may comprise one or two of the following fabric softening agents:

(a) the reaction product of higher fatty acids with a polyamine selected from the group consisting of hydroxyalkylalkylenediamines and dialkylenetriamines and mixtures thereof (preferably from about 10% to about 80%); and/or (b) cationic nitrogenous salts containing long chain acyclic aliphatic $C_{15}$–$C_{22}$ hydrocarbon groups (preferably from about 3% to about 40%); with said (a) and (b) preferred percentages being by weight of the fabric softening agent component of the present invention compositions.

Following are the general descriptions of the preceding (a) and (b) softener ingredients (including certain specific examples which illustrate, but do not limit the present invention).

Component (a): Softening agents (actives) of the present invention may be the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (a) is a nitrogenous compound selected from the group consisting of the reaction product mixtures or some selected components of the mixtures. More specifically, the preferred Component (a) is compounds selected from the group consisting of substituted imidazoline compounds having the formula:

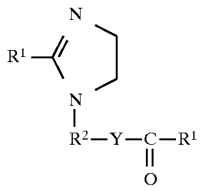

wherein $R^1$ is an acyclic aliphatic $C_{15}$–$C_{21}$ hydrocarbon group and $R^2$ is a divalent $C_1$–$C_3$ alkylene group, and Y is NH or O.

Component (a) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$–$C_{17}$ hydrocarbon group and $R^2$ is a divalent ethylene group).

Certain of the Components (a) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl- 1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

Component (b): The preferred Component (b) is a cationic nitrogenous salt, preferably selected from acyclic quaternary ammonium salts having the formula:

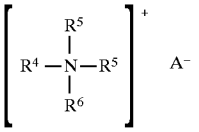

wherein $R^4$ is an acyclic aliphatic $C_{15}$–$C_{22}$ hydrocarbon group, $R^5$ is $R^4$ or $C_1$–$C_4$ saturated alkyl or hydroxy alkyl groups, and $R^6$ is $R^4$ or $R^5$ and A− is an anion.

Examples of Component (b) are the monoalkyltrimethylammonium salts such as monotallowtrimethylammonium chloride, mono(hydrogenatedtallow)trimethylammonium chloride, palmityltrimethyl ammonium chloride and soyatrimethylammonium chloride, sold by Witco Chemical Company under the trade name Adogen® 471, Adogen® 441, Adogen® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred. Further examples include dialkyldi methylammonium salts such as ditallowdimethylammonium chloride. Examples of commercially available dialkyldimethyl ammonium salts usable in the present invention are di(hydrogenated tallow) dimethylammonium chloride (tradename Adogen® 442), ditallowdimethyl ammonium chloride (trade name Adogen® 470), distearyl dimethylammonium chloride (trade name Arosurf® TA-100), all available from Witco Chemical Company, dimethylstearylbenzyl ammonium chloride sold under the trade names Varisoft® SDC by Witco Chemical Company and Ammonyx® 490 by Onyx Chemical Company. Also preferred are those selected from the group consisting of di(hydrogenated tallow) dimethylammonium chloride, ditallowdimethylammonium chloride. Mixtures of the above examples are also included within the scope of the present invention.

A preferred compound of Component (a) include the reaction product of about 2 moles of hydrogenated tallow fatty acids with about 1 mole of N-2-hydroxyethylethylenediamine or diethylene triamine and is present at a level of from about 20% to about 70% by weight of the fabric softening component of the present invention compositions while preferred compounds of component (b) include mono(hydrogenated tallow)trimethyl ammonium chloride and di(hydrogenated tallow)dimethyl ammonium chloride present at a level of from about 3% to about 30% by weight of the fabric softening component of the present invention compositions; 1-tallowamidoethyl-2-tallowimidazoline, and mixtures thereof; wherein mixtures of compounds of (a) and (b) are present at a level of from about 20% to about 60% by weight of the fabric softening component of the present invention compositions; and wherein the weight ratio of said di(hydrogenated tallow) dimethylammonium chloride to said 1-tallowamidoethyl-2-tallowimidazoline is from about 1:2 to about 6:1.

In the cationic nitrogenous salts described herein before, the anion A− provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion A−.

Nonionic Softening Compounds

Softening agents also useful in the compositions of the present invention are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0% to about 10%, preferably from about 1% to about 5% by weight of the composition.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid, oleic and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described herein before for the sorbitan and glycerol esters.

In addition, since the foregoing compounds (diesters) are somewhat labile to hydrolysis, they should be handled rather carefully when used to formulate the compositions herein. For example, stable liquid compositions herein are formulated at a pH (neat) in the range of from about 2 to about 7, preferably from about 2 to about 5, more preferably from about 2 to about 4.5. For best product odor stability, when the IV is greater that about 25, the neat pH is from about 2.8 to about 3.5, especially for lightly scented products. This appears to be true for all of the above softener compounds and is especially true for the preferred DEQA specified herein, i.e., having an IV of greater than about 20, preferably greater than about 40. The limitation is more important as IV increases. The pH can be adjusted by the addition of a Bronsted acid as described above. pH ranges for making chemically stable softener compositions containing diester quaternary ammonium fabric softening compounds are disclosed in U.S. Pat. No. 4,767,547, Straathof et al., issued on Aug. 30, 1988, which is incorporated herein by reference.

Liquid compositions of this invention typically contain from about 0.05% to about 50%, preferably from about 2% to about 40%, more preferably from about 4% to about 32%, of quaternary ammonium softener active. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

(3) Carrier Ingredients

The liquid carrier employed in the instant compositions is preferably water due to its low cost, relative availability, safety, and environmental compatibility. The level of water in the liquid carrier is generally more than about 50%, preferably more than about 80%, more preferably more than about 85%, by weight of the carrier. The level of liquid carrier is generally greater than about 50%, preferably greater than about 65%, more preferably greater than about 70% of the instant composition. Mixtures of water and low molecular weight, e.g., <about 100, organic solvent, e.g., lower alcohol such as ethanol, propanol, isopropanol or butanol; propylene carbonate; and/or glycol ethers, are useful as the carrier liquid. Low molecular weight alcohols include monohydric such as $C_{1-4}$ monohydric alcohols, dihydric (glycol, etc.) trihydric (glycerol, etc.), and polyhydric (polyols) alcohols, such as $C_{2-6}$ polyhydric alcohols.

(4) Additional Ingredients

Fully formulated fabric softening compositions may contain, in addition to the herein before described components, one or more of the following ingredients.

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

In addition, the compositions of the present invention may include less than about 1% by weight of an amphoteric surfactant. Preferably, the compositions include less than about 0.9% and more preferably less than about 0.75% by weight of an amphoteric surfactant.

(5) Dispersibility Modifiers

Viscosity/dispersibility modifiers can be added for the purpose of facilitating the solubilization and/or dispersion, concentration, and/or improving phase stability (e.g., viscosity stability). Some preferred dispersibility modifiers may include:

(A) Single-Long-Chain Alkyl Cationic Surfactant

The mono-long-chain-alkyl (water-soluble) cationic surfactants in liquid compositions are at a level of from 0% to about 30%, preferably from about 0.5% to about 10%, the total single-long-chain cationic surfactant present being at least at an effective level.

Such mono-long-chain-alkyl cationic surfactants useful in the present invention are, preferably, quaternary ammonium salts of the general formula:

$$(R^2N^+R_3)X^-$$

wherein the $R^2$ group is a $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester; each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

The ranges above represent the amount of the single-long-chain-alkyl cationic surfactant which is preferably added to the composition of the present invention. The ranges do not include the amount of monoester which is already present in component (A), the diester quaternary ammonium compound, the total present being at least at an effective level.

The long chain group $R^2$, of the single-long-chain-alkyl cationic surfactant, typically contains an alkyl, or alkylene group having from about 10 to about 22 carbon atoms, preferably from about 12 to about 16 carbon atoms for solid compositions, and preferably from about 12 to about 18 carbon atoms for liquid compositions. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

It will be understood that the main function of the water-soluble cationic surfactant is to lower the composition's viscosity and/or increase the dispersibility of the diester softener compound and it is not, therefore, essential that the cationic surfactant itself have substantial softening properties, although this can be the case. Also, surfactants having only a single long alkyl chain, presumably because they have greater solubility in water, can protect the diester softener from interacting with anionic surfactants and/or detergent builders that are carried over into the rinse.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts useful in the present invention have the general formula:

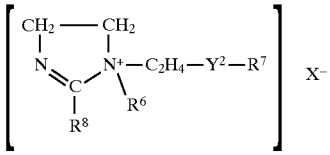

wherein $Y^2$ is —C(O)—O—, —O—(O)—C—, —C(O)—N($R^5$), or —N($R^5$)—C(O)— in which $R^5$ is hydrogen or a $C_1$–$C_4$ alkyl radical; $R_6$ is a $C_1$–$C_4$ alkyl radical; $R_7$ and $R_8$ are each independently selected from R and $R^2$ as defined herein before for the single-long-chain cationic surfactant with only one being $R^2$.

Some alkyl pyridinium salts useful in the present invention have the general formula:

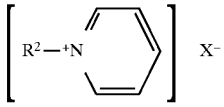

wherein $R^2$ and $X^-$ are as defined above. A typical material of this type is cetyl pyridinium chloride.

Amine oxides can also be used. Suitable amine oxides include those with one alkyl, or hydroxyalkyl, moiety of about 8 to about 22 carbon atoms, preferably from about 10 to about 18 carbon atoms, more preferably from about 12 to about 14 carbon atoms, and two alkyl moieties selected from the group consisting of alkyl groups and hydroxyalkyl groups containing from one to about three carbon atoms.

Examples of amine oxides include: dimethyloctylamine oxide; diethyldecylamine oxide; dimethyldodecylamine oxide; dipropyltetradecylamine oxide; dimethyl-2-hydroxyoctadecylamine oxide; dimethylcoconutalkylamine oxide; and bis-(2-hydroxyethyl)dodecylamine oxide.

(B) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc. They are referred to herein as ethoxylated fatty alcohols, ethoxylated fatty acids, and ethoxylated fatty amines.

Any of the alkoxylated materials of the particular type described hereinafter can be used as the nonionic surfactant. In general terms, the nonionic herein, when used alone, are at a level of from 0% to about 5%, preferably from about 0.1% to about 5%, more preferably from about 0.2% to about 3%. Suitable compounds are substantially water-soluble surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length is from about 16 to about 18 carbon atoms. In the general formula for the ethoxylated nonionic surfactants herein, Y is typically —O—, —C(O)O—, —C(O)N(R)—, or —C(O)N(R)R—, preferably —O—, and in which $R^2$, and R, when present, have the meanings given herein before, and/or R can be hydrogen, and z is at least about 8, preferably at least about 10–11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups can possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxy (EO) groups in the molecule.

(C) Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n-$C_{18}$EO(10); and n-$C_{10}$EO(11). The ethoxylates of mixed natural or synthetic alcohols in the "tallow" chain length range are also useful herein. Specific examples of such materials include tallow alcohol-EO(11), tallow alcohol-EO (18), and tallow alcohol -EO(25).

(D) Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein are useful viscosity/dispersibility modifiers in the context of this invention. Exemplary ethoxylated secondary alcohols useful herein as the viscosity/dispersibility modifiers of the compositions are: 2-$C_{16}$EO(11); 2-$C_{20}$EO(11); and 2-$C_{16}$EO(14).

(E) Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

(F) Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

(G) Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(H) Mixtures

The term "mixture" includes the nonionic surfactant and the single-long-chain-alkyl cationic surfactant added to the composition in addition to any monoester present in the DEQA.

Mixtures of the above viscosity/dispersibility modifiers are highly desirable. The single long chain cationic surfactant provides improved dispersibility and protection for the primary DEQA against anionic surfactants and/or detergent builders that are carried over from the wash solution. The viscosity/dispersibility modifiers are present at a level of from about 0.1% to about 30%, preferably from about 0.2% to about 20%, by weight of the composition.

(7) Stabilizers

Stabilizers can be present in the compositions of the present invention. The term "stabilizer," as used herein, includes antioxidants and reductive agents both of which are well-known in the art. These agents are present at a level of from 0% to about 2%, preferably from about 0.01% to about 0.2%, more preferably from about 0.035% to about 0.1% by weight of the composition for antioxidants, and more preferably from about 0.01% to about 0.2% by weight of the composition for reductive agents. These assure good odor stability under long term storage conditions for the compositions and compounds stored in molten form. The use of antioxidants and reductive agent stabilizers is especially desirable for low scent products (low perfume).

(8) Soil Release Polymer

Optionally, the compositions herein contain from 0.01% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

A more complete disclosure of these highly preferred soil release agents is contained in European Pat. Application 185,427, Gosselink, published Jun. 25, 1986, incorporated herein by reference.

(9) Cellulase

An optional cellulase may be used in the compositions herein. The cellulase can be any bacterial or fungal cellulase. Suitable cellulase is disclosed, for example, in GB-A-2 075 028, GB-A-2 095 275 and DE-OS-24 47 832, all incorporated herein by reference in their entirety.

Examples of such cellulase are cellulase produced by a strain of Humicola insolens (Humicola grisea var. thermoidea), particularly by the Humicola strain DSM 1800, and cellulase 212-producing flngus belonging to the genus Aeromonas, and cellulase extracted from the hepatopancreas of a marine mullosc (Dolabella Auricula Solander).

The cellulase added to the composition of the invention can be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium.

Preferred cellulase for use herein are characterized in that they provide at least 10% removal of immobilized radioactive labeled carboxymethyl-cellulose according to the $C_1^4$CMC-method described in EPA 350,098 (incorporated herein by reference in its entirety) at $25\times10^{-6}$% by weight of cellulase protein in the laundry test solution.

The most preferred cellulase is that described in International Patent Application WO 91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

The cellulase herein should be used in the liquid fabric-conditioning compositions of the present invention at a level equivalent to an activity from about 1 to about 125 CEVU/gram of composition (CEVU=Cellulase Equivalent Viscosity Unit, as described, for example, in WO 91/13136, incorporated herein by reference in its entirety), and preferably an activity of from about 5 to about 100.

(10) Principal Solvent System

The rinse-added laundry compositions may take the form of clear or translucent liquid compositions. In such instances, the compositions may also include a principal solvent system. When employed, the principal solvent preferably comprises less than about 40%, preferably from about 10% to about 35%, more preferably from about 12% to about 25%, and even more preferably from about 14% to about 20%, by weight of the composition. The principal solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about 6.7° C.).

The suitability of any principal solvent for the formulation of the liquid, concentrated, preferably clear, fabric softener compositions herein with the requisite stability is surprisingly selective. Suitable solvents can be selected based upon their octanol/water partition coefficient (P). Octanol/water partition coefficient of a principal solvent is the ratio between its equilibrium concentration in octanol and in water. The partition coefficients of the principal solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. These ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.-Chim. Theor., 19, 71 (1984). The principal solvents herein are selected from those having a ClogP of from about 0.15 to about 0.64, preferably from about 0.25 to about 0.62, and more preferably from about 0.40 to about 0.60, said principal solvent preferably being at least somewhat asymmetric, and preferably having a melting, or solidification, point that allows it to be liquid at, or near room temperature. Solvents that have a low molecular weight and are biodegradable are also desirable for some purposes. The more assymetric solvents appear to be very desirable, whereas the highly symmetrical solvents such as 1,7-heptanediol, or 1,4-bis(hydroxymethyl) cyclohexane, which have a center of symmetry, appear to be unable to provide the essential clear compositions when used alone, even though their ClogP values fall in the preferred range.

The most preferred principal solvents can be identified by the appearance of the softener vesicles, as observed via cryogenic electron microscopy of the compositions that have been diluted to the concentration used in the rinse. These dilute compositions appear to have dispersions of fabric softener that exhibit a more unilamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active.

Operable principal solvents are disclosed and listed below which have ClogP values which fall within the requisite range. These include mono-ols, C6 diols, C7 diols, octanediol isomers, butanediol derivatives, trimethylpentanediol isomers, ethylmethylpentanediol isomers, propyl pentanediol isomers, dimethylhexanediol isomers, ethylhexanediol isomers, methylheptanediol isomers, octanediol isomers, nonanediol isomers, alkyl glyceryl ethers, di(hydroxy alkyl) ethers, and aryl glyceryl ethers, aromatic glyceryl ethers, alicyclic diols and derivatives, $C_3C_7$ diol alkoxylated derivatives, aromatic diols, and unsaturated diols. Particularly preferred principal solvents include hexanediols such as 1,2-Hexanediol and 2-Ethyl-1,3-hexanediol and pentanediols such as 2,2,4-Trimethyl-1,3-pentanediol. These principal solvents are all disclosed in copending U.S. patent application Ser. Nos. 08/621,019; 08/620,627; 08/620,767; 08/620,513; 08/621,285; 08/621,299; 08/621,298; 08/620,626; 08/620,625; 08/620,772; 08/621,281; 08/620,514; and 08/620,958, all filed Mar. 22, 1996 and all having the title "CONCENTRATED, STABLE, PREFERABLY CLEAR, FABRIC SOFTENING COMPOSITION", the disclosures of which are all herein incorporated by reference.

(11) Other Ingredients

Other preferred optional ingredients include, but are not limited to, dye transfer inhibiting agents, polymeric dispersing agents, suds suppressors, optical brighteners or other brightening or whitening agents, dye fixing agents, light fading protection agents, oxygen bleach protection agents, fabric softening clay, anti-static agents, other active ingredients, carriers, hydrotropes, processing aids, dyes or pigments, bacteriocides, colorants, perfumes, preservatives, opacifiers, anti-shrinkage agents, anti-wrinkle agents, fabric crisping agents, spotting agents, germicides, fungicides, anti-corrosion agents, and the like.

Accordingly, the present invention also comprises a method for laundering fabrics or garments by contacting the fabrics or garments with the compositions of the present invention. Most preferably, the method includes contacting the fabrics or garments with the compositions during the rinse portion of a laundering process comprising both washing and rinsing steps. Thus, the method is also capable of providing a fabric or garment with wrinkle reduction, water absorbency, color appearance and fabric wear properties. The compositions can be added directly in the rinse both to provide adequate usage concentration, e.g., at least about 50 ppm and more preferably of from about 100 to about 10,000 ppm of the liquid rinse added fabric softeners of the present invention In the specification and examples herein, all percentages, ratios and parts are by weight unless otherwise specified and all numerical limits are normal approximations.

The following examples illustrate the esters and compositions of this invention, but are not intended to be limiting thereof.

EXAMPLE I

Liquid fabric softening compositions according to the present invention are formulated as follows:

| Ingredient | A Wt. % | B Wt. % | C Wt. % | D Wt. % | E Wt. % | F Wt. % |
|---|---|---|---|---|---|---|
| Fabric Softening Compound (1) | 24.0 | — | 25.0 | — | — | — |
| Fabric Softening Compound (2) | — | 19.2 | — | — | — | — |

-continued

| Ingredient | A Wt. % | B Wt. % | C Wt. % | D Wt. % | E Wt. % | F Wt. % |
|---|---|---|---|---|---|---|
| Fabric Softening Compound (3) | — | — | — | 18.0 | — | — |
| Fabric Softening Compound (4) | — | — | — | — | 11.0 | 4.0 |
| Fabric Softening Compound (5) | — | — | — | — | 13.5 | — |
| Fabric Softening Compound (6) | — | — | — | — | — | 3.4 |
| Ethanol | 4.0 | — | 4.0 | — | 5.0 | 1.0 |
| Isopropanol | — | 3.0 | — | 6.0 | — | — |
| Color Care Agent (7) | 2.5 | 3 | 2 | 4 | 3.0 | 3.0 |
| Calcium Chloride | 2.0 | 0.2 | 0.6 | 0.5 | 0.5 | 0.05 |
| Hydrochloric acid | 0.75 | 0.06 | 0.05 | 0.02 | — | 0.2 |
| Soil Release Agent (8) | 0.5–1 | 0.2 | 0.5 | — | — | — |
| Silicone Anti-foam | 0.01 | 0.01 | 0.01 | — | — | 0.01 |
| Misc. | 1.4 | 0.7 | 1.3 | 1.0 | 1.0 | 0.4 |
| Water | to 100 | to 100 | to 100 | to 100 | to 100 | to 100 |

(1) N,N-di(tallowyl-oxy-ethyl)-N,N-dimethyl ammonium chloride (IV 50)
(2) N,N-di(tallowyl-oxy-ethyl)-N,N-dimethyl ammonium chloride (IV 18)
(3) 1,2-ditallowyloxy-3-N,N,N-trimethylammoniopropane chloride
(4) Ditallow dimethyl ammonium chloride
(5) Methyl bis(tallow amidoethyl)2-hydroxyethyl ammonium methyl sulfate
(6) 1-tallowamidoethyl-2-talloimidazoline
(7) N,N,N',N'-tetrakis-(2-hydroxypropyl)ethylenediamine
(8) Dimethyl-terephthalate, 1,2 propylene glycol, methyl capped PEG polymer

EXAMPLE II

The liquid fabric softening compositions are prepared as follows:

The fabric softening compound containing ethanol is melted in a water bath at a temperature of from about 70° to about 75° C. to from a molten organic phase. Separately, the color care agent, silicone anti-foaming agent and hydrochloric acid are added to water, covered and heated to a temperature of from about 70° to about 75° C.

The aqueous system is transferred to an insulated baffled mixing vessel which is fitted with a turbine blade impeller. The molten organic phase is slowly added to the aqueous phase under high speed agitation. The dispersion becomes highly viscous. A small portion of the total calcium chloride is slowly added to the dispersion as a 2.5% solution.

The dispersion is milled using a probe rotor-stator high shear device for a period of time corresponding to batch size. The milled product is chilled in an ice bath to room temperature over a 3–6 minute period. In sequence, phase stabilizer, perfume, ammonium chloride and remaining calcium chloride are added with vigorous mixing. Dye may then be added as desired. The final product is very fluid with a viscosity of less than 100 centipoise and has a pH of about 3.

EXAMPLE III

The liquid fabric softening compositions are prepared as follows:

The fabric softening compound containing isopropanol is melted in a water bath at a temperature of from about 75° to about 80° C. to from a molten organic phase. Separately, the color care agent, silicone anti-foaming agent and hydrochloric acid are added to water, covered and heated to a temperature of from about 75° to about 80° C.

The aqueous system is transferred to an insulated baffled mixing vessel which is fitted with a turbine blade impeller. The molten organic phase is slowly added to the aqueous phase under high speed agitation. The dispersion becomes highly viscous. A portion of the total calcium chloride is slowly added to the dispersion as a 25% solution until viscosity is drastically reduced.

The dispersion is chilled to ambient temperature in an ice bath to over a 3–6 minute period. In sequence, phase stabilizer, perfume, and remaining calcium chloride are added with vigorous mixing. Dye may then be added as desired. The final product is very fluid with a viscosity of less than 100 centipoise and has a pH of about 3.

EXAMPLE IV

Liquid fabric softening compositions according to the present invention are formulated as follows:

| Ingredient | A Wt. % | B Wt. % | C Wt. % |
|---|---|---|---|
| Fabric Softening Compound (1) | 2.0 | — | — |
| Isopropanol | 0.3 | 0.3 | 0.3 |
| Color Care Agent (2) | 5 | 25 | 15 |
| Calcium Chloride | 0.05 | — | — |
| Hydrochloric acid | 0.5 | 0.5 | 0.5 |
| Soil Release Agent (3) | 0.2 | — | 0.2 |
| Silicone Anti-foam | 0.01 | 0.01 | 0.01 |
| Polyethylene glycol 4000 | 0.6 | 0.6 | 0.6 |
| Misc. | 0.7 | 0.7 | 0.7 |
| Water | to 100 | to 100 | to 100 |

(1) N,N-di(tallowyl-oxy-ethyl)-N,N-dimethyl ammonium chloride (IV 18)
(2) N,N,N',N'-tetrakis-(2-hydroxypropyl)ethylenediamine
(3) Dimethyl-terephthalate, 1,2 propylene glycol, methyl capped PEG polymer

What is claimed is:

1. A rinse added laundry additive composition comprising:

a) from about 0.1% to about 50% of by weight, of the composition N,N,N',N'-tetrakis-(2-hydroxypropyl) ethylenediamine;

b) from about 0.05% to about 50% by weight, of one or more quaternary ammonium fabric softening compounds or amine precursors thereof having the formula:

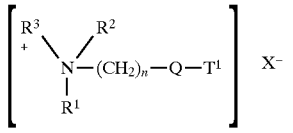

(I)

or

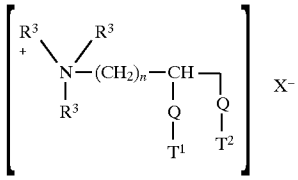

(II)

wherein Q is —O—C(O)— or —C(O)—O— or —O—C(O)—O— or —$NR^4$—C(O)— or —C(O)—$NR^4$—;

$R^1$ is $(CH_2)_n$—Q—$T^2$ or $T^3$ or $R^3$; $R^2$ is $(CH_2)_m$—Q—$T^4$ or $T^5$ or $R^3$; $R^3$ is $C_1$–$C_4$ alkyl or $C_1$–$C_4$ hydroxyalkyl or H; $R^4$ is H or $C_1$–$C_4$ alkyl or $C_1$–$C_4$ hydroxyalkyl; $T^1$, $T^2$, $T^3$, $T^4$, $T^5$ are the same or different $C_{11}$–$C_{22}$ alkyl or alkenyl; n and m are integers from 1 to 4; and $X^-$ is a softener-compatible anion, the alkyl, or alkenyl, chain $T^1$, $T^2$, $T^3$, $T^4$, $T^5$ must contain at least 11 carbon atoms; and c) the balance comprising a liquid carrier selected from the group consisting of water, $C_1$–$C_4$ monohydric alcohol, $C_2$–$C_6$ polyhydric alcohol, propylene carbonate, liquid polyethylene glycols, and mixtures thereof.

2. A composition according to claim 1 wherein said quaternary ammonium compound is N,N-di(tallowyl-oxyethyl)-N,N-dimethyl ammonium chloride.

3. A liquid rinse added fabric softening composition comprising:

a) from about 0.05% to about 50% by weight of the composition of a quaternary ammonium fabric softening compound or amine precursor thereof having the formula:

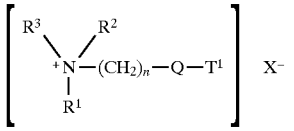

(I)

or

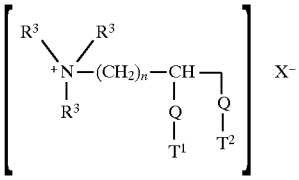

(II)

wherein Q is —O—C(O)— or —C(O)—O— or —O—C(O)—O— or —$NR^4$—C(O)— or —C(O)$NR^4$—;

$R^1$ is $(CH_2)_n$—Q—$T^2$ or $T^3$ or $R^3$; $R^2$ is $(CH_2)_m$—Q—$T^4$ or $T^5$ or $R^3$; $R^3$ is $C_1$–$C_4$ alkyl or $C_1$–$C_4$ hydroxyalkyl or H; $R^4$ is H or $C_1$–$C_4$ alkyl or $C_1$–$C_4$ hydroxyalkyl;

$T^1$, $T^2$, $T^3$, $T^4$, $T^5$ are the same or different $C_{11}$–$C_{22}$ alkyl or alkenyl; n and m are integers from 1 to 4; and $X^-$ is a softener-compatible anion, the alkyl, or alkenyl, chain $T^1$, $T^2$, $T^3$, $T^4$, $T^5$ must contain at least 11 carbon atoms;

b) from about 0.1% to about 50% of by weight, of the composition N,N,N',N'-tetrakis-(2-hydroxypropyl) ethylenediamine;

c) optionally, from about 0% to about 30% by weight of the composition of a dispersibility modifier; and c) the balance comprising a liquid carrier selected from the group consisting of water; $C_1$–$C_4$ monohydric alcohol; $C_2$–$C_6$ polyhydric alcohol; propylene carbonate; liquid polyethylene glycols; and mixtures thereof.

4. A composition according to claim 3 wherein said quaternary ammonium compound is N,N-di(tallowyl-oxyethyl)-N,N-dimethyl ammonium chloride.

* * * * *